US005090061A

United States Patent [19]

Kamata

[11] Patent Number: 5,090,061

[45] Date of Patent: Feb. 25, 1992

[54] HELMET WITH EAR PADS

[75] Inventor: Eitaro Kamata, Tokyo, Japan

[73] Assignee: Shoei Kako Kabushiki Kaisha, Tokyo, Japan

[21] Appl. No.: 607,399

[22] Filed: Oct. 31, 1990

[30] Foreign Application Priority Data

Aug. 15, 1990 [JP] Japan ..... 2-215203

[51] Int. Cl.[5] ..... A42B 1/08

[52] U.S. Cl. ..... 2/423

[58] Field of Search ..... 2/410, 411, 414, 421, 2/422, 423, 425

[56] References Cited

U.S. PATENT DOCUMENTS

| | | | |
|---|---|---|---|
| 2,805,419 | 9/1957 | Finken | 2/423 |
| 2,844,820 | 7/1958 | Austin et al. | 2/423 |
| 3,021,526 | 2/1962 | Lastnik | 2/423 |
| 3,091,771 | 6/1963 | Bixby | 2/423 |
| 3,470,564 | 10/1969 | Aileo | 2/423 |
| 3,911,496 | 10/1975 | Arai et al. | 2/423 |
| 4,114,197 | 9/1978 | Morton | 2/423 |

FOREIGN PATENT DOCUMENTS

| | | | |
|---|---|---|---|
| 2324686 | 12/1973 | Fed. Rep. of Germany | 2/423 |

*Primary Examiner*—Werner H. Schroeder
*Assistant Examiner*—Michael A. Neas
*Attorney, Agent, or Firm*—Armstrong, Nikaido, Marmelstein, Kubovcik & Murray

[57] ABSTRACT

A helmet has ear pads each secured to the inner surface of a supporting plate in a cap body. Between the cap body and the supporting plate, first and second retaining devices are provided. The first device provides separation and engagement between the cap body and the supporting plate in response to relative sliding movement of these two members in a first direction between a separating position and an engaged position. The second device provides separation and engagement of the two members in response to movement of an operating member between its separating and engaging positions in a second direction substantially perpendicular to the first direction. The attaching and detaching operations of the ear pads are facilitated thereby, and deviation of the ear pads at the time of wearing the helmet can be eliminated.

5 Claims, 5 Drawing Sheets

HELMET WITH EAR PADS

BACKGROUND OF THE INVENTION

1. Field of the Invention

The present invention relates to a helmet comprising a cap body including ear cover portions at both sides of a window in a front face and ear pads disposed inwardly of both the ear cover portions, and more particularly, to an improvement in a structure for mounting the ear pads to the cap body.

2. Description of the Prior Art

There is conventionally known a helmet, for example, as disclosed in Japanese Utility Model Application Laid-Open No. 62-83832.

Since ear pads are apt to become dirty, it is desirable that they can easily be removed from a cap body for washing. Conventional ear pads are attached to a cap body using magic tape. Such ear pads can be easily attached to or detached from the cap body, but they are apt to be deviated at the time of mounting and this may impart an unfamiliar feeling to a user.

SUMMARY OF THE INVENTION

The present invention has been accomplished with such circumstances in view. It is an object of the present invention to provide a helmet of the type described above, in which attachment or detachment of ear pads to or from a cap body is facilitated and the attached state of the ear pads is reliably maintained.

To achieve the above object, according to the present invention, there is provided a helmet comprising a cap body including ear cover portions at opposite sides of a window provided in a front face and ear pads arranged inwardly of the ear cover portions, wherein each of the ear pads is secured to an inner surface of a supporting plate, and the helmet further comprising, between the cap body and each of the supporting plates, first retaining device capable of separating and engaging the cap body and the supporting plate away from and with each other by a relative sliding movement of the cap body and the supporting plate performed in a first direction between a first separating position and a first engaging position, and second retaining device capable of separating and engaging the cap body and the supporting plate away from and with each other by a movement of an operating member between a second separating position and a second engaging position which is performed in a second direction substantially perpendicular to the first direction.

With such a construction, when the ear pads are attached to the cap body, the supporting plate is slid along the first direction with respect to the cap body to engage the supporting plate with the cap body by the first retaining device. In this state, the operating member is moved from the separating position to the engaging position along the direction substantially perpendicular to the first direction to provide further engagement between the cap body and the supporting plate through the second retaining device. Thus the supporting plates, i.e., the ear pads are secured to the cap body. Further, since the directions of operations which are established by connecting respective separating and engaging positions of the first and second retaining devices are substantially perpendicularly crossed, the fixed state of the ear pads to the cap body can reliably be maintained. Further, when the ear pads are detached from the cap body, the reverse operation to the above described attaching operation may be performed, and both operations are simple.

These and other objects and features of the present invention will become apparent from the following detailed description in conjunction with the attached drawings.

DESCRIPTION OF THE PREFERRED EMBODIMENTS

Figure 1:
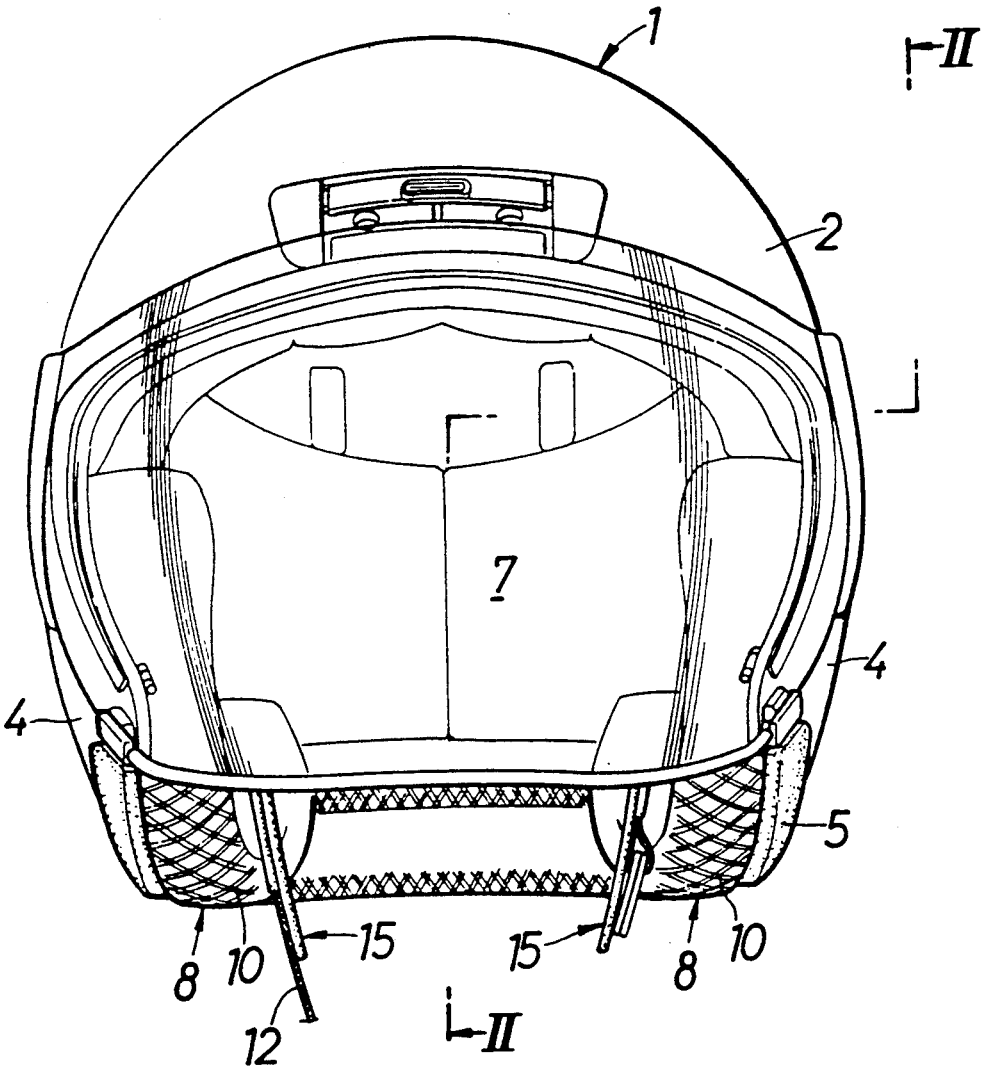
FIG. 1 is a front view of an embodiment of a helmet according to the present invention.
Figure 2:
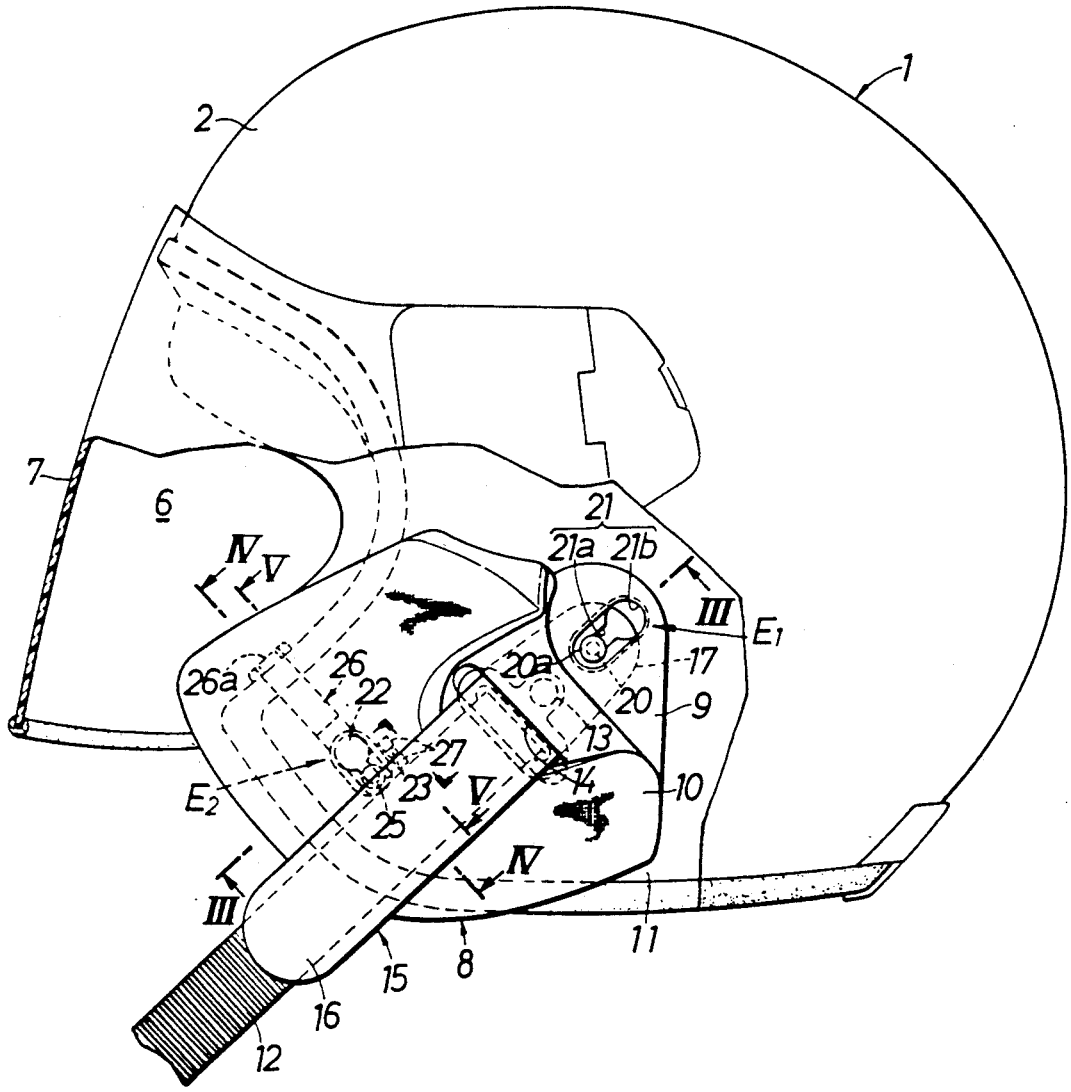
FIG. 2 is a side fragmentary view taken along the line II—II of FIG. 1.
Figure 3:
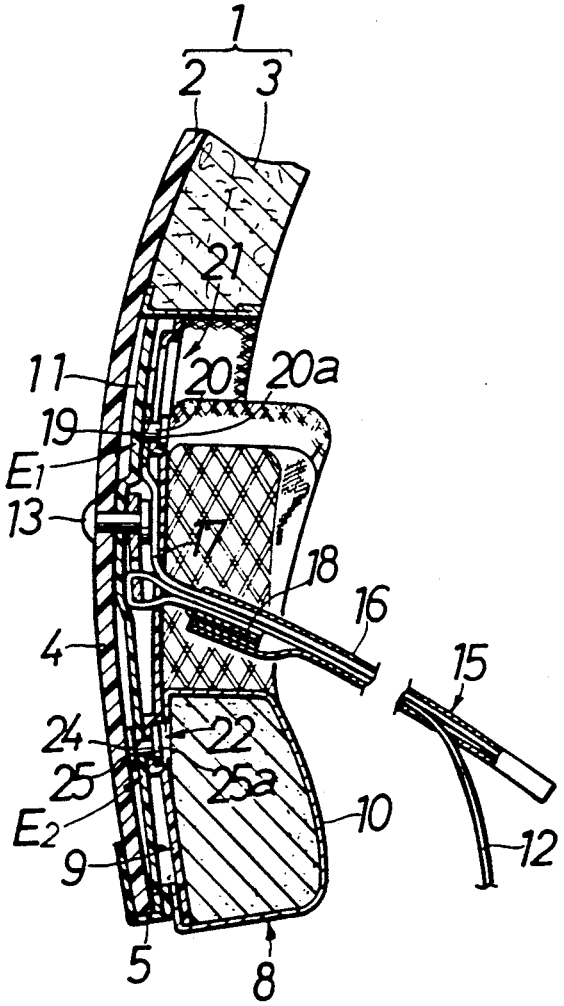
FIG. 3 is a sectional view taken along the line III—III of FIG. 2.
Figure 4:
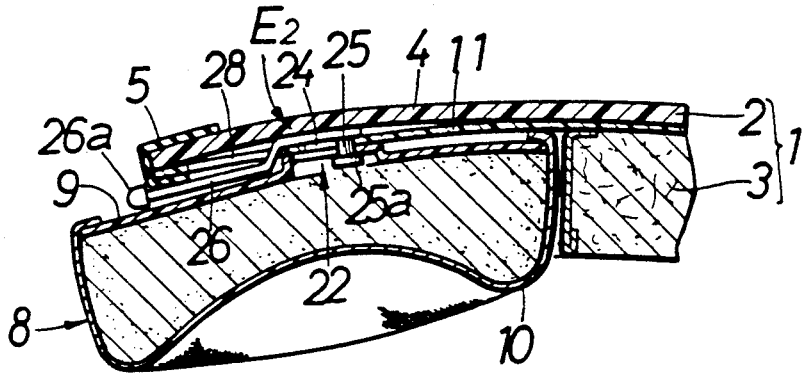
FIG. 4 is a sectional view taken along the line IV—IV of FIG. 2.
Figure 5:
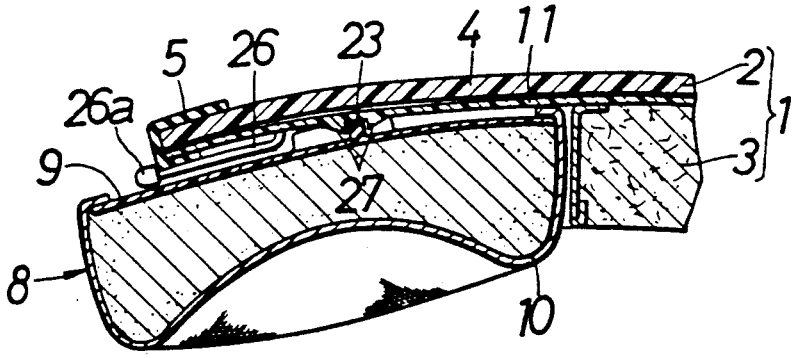
FIG. 5 is a sectional view taken along the line V—V of FIG. 2.

The present invention will now be described by way of one embodiment with reference to the accompanying drawings.

Referring first to FIGS. 1 to 5, a helmet according to a first embodiment is so-called a jet type helmet. The helmet has a cap body 1. The cap body 1 comprises a shell 2 made of a hard, high strength resin including a pair of left and right ear cover portions 4, 4 for covering the peripheries of the ears of a user at both sides of a window 6 at a front face, and a buffer liner 3 made of styrene foam adhesively bonded to the inner surface of the shell 2 except at both ear cover portions 4, 4. A rubber edge member 5 is fitted around and adhesively bonded to the end edge of the shell 2. A shield plate 7 for covering the window 6 is upwardly turnably supported at both ends thereof to both sides of the cap body 2.

Ear pads 8 for receiving user's ears are detachably attached to the inner surfaces of the ear cover portions 4, 4. Each of the ear pads 8 is formed substantially in C-shape to form a recess for receiving user's ear between the pad 8 and the lower end of the buffer liner 3. Each ear pad 8 is fixed to the inner surface of a supporting plate 9 made of a synthetic resin having relatively high rigidity. More specifically, each of the ear pads 8 is fixed to the supporting plate 9 by sewing a cloth cushion cover 10 covering the ear pad 8 to the supporting plate 9.

On the other hand, a cover plate 11 opposed to the supporting plate 9 to cover the interior of each ear cover portion 4 is fixed to the cap body 1. More particularly, the cover plate 11 is formed of a synthetic resin having relatively high rigidity and is fixed to the cap body 1 such that peripheral portion thereof is clamped between the buffer liner 3 and the shell 2 and between the edge member 5 and the shell 2.

Figure 6:
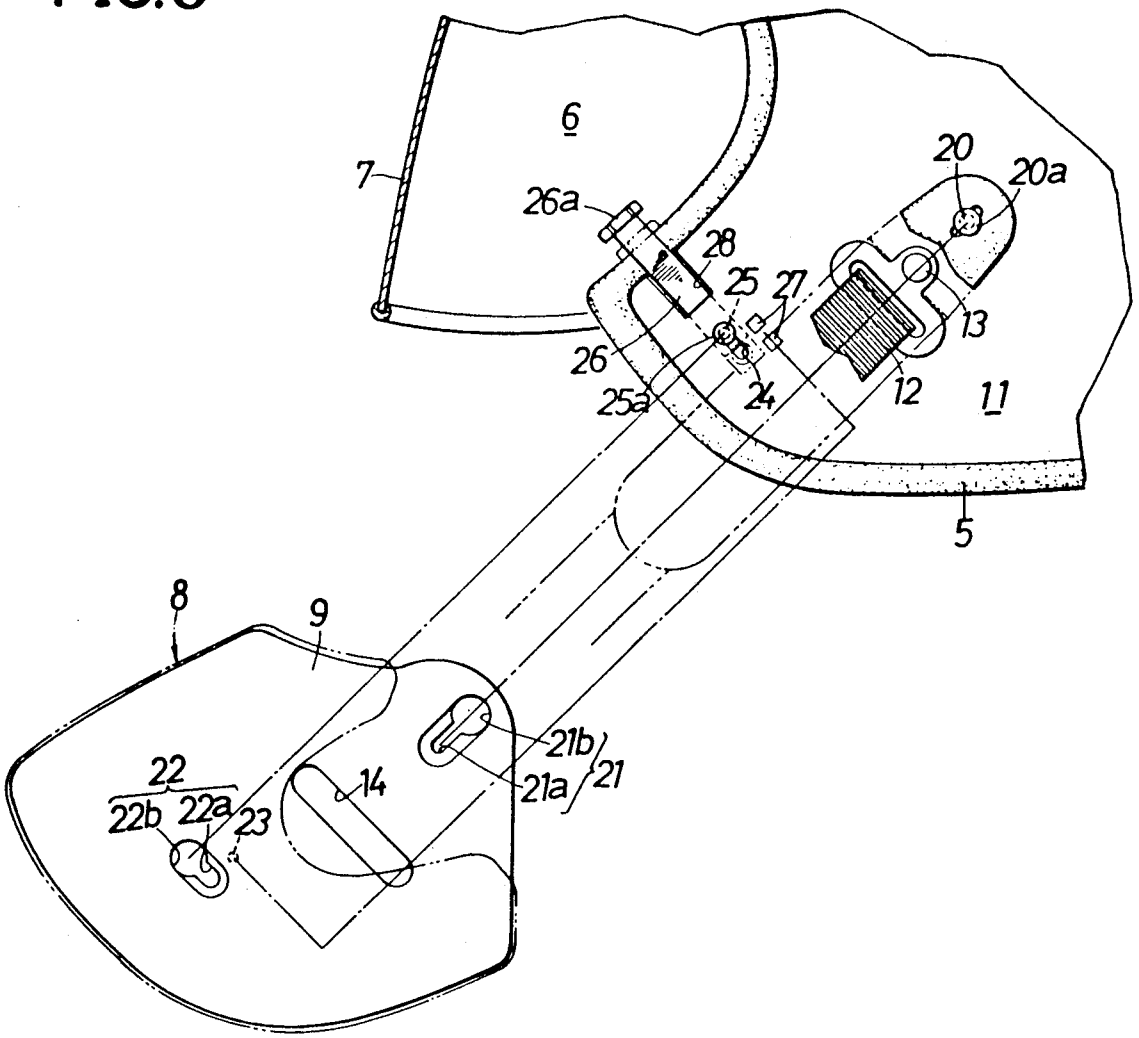
FIG. 6 is an exploded side view of a cap body and a supporting plate.

Referring also to FIG. 6, a pair of chin straps 12 capable of being fastened to each other for fixing the cap body 1 to the head of the user are fixed at one ends thereof to the ear cover portions 4 through rivets 13. The chin straps 12 are inwardly extended and passed through insertion holes 14 provided at the supporting plates 9.

At least part of each chin strap 12 is covered with a basically tube like chin strap cover 15. The chin strap cover 15 is comprised of a cover body 16 formed into a tube shape with an inner surface portion thereof made of cloth with which the user's cheek and chin come in contact, and a coupling band 17 made of a synthetic resin connected to one end of the cover body 16. The portion of the chin belt 12 near the rivet 13 is detachably attached to the inner surface of one end of the cover body 16 through magic tape 18.

The coupling band 17 is provided at an end portion thereof with a coupling hole 19. A first engaging pin 20 provided on the cover plate 11 is fitted in and connected to the coupling hole 19. This first engaging pin 20 has a first enlarged head 20*a* at a tip end thereof and is so inserted into the coupling hole 19 as to engage the first enlarged head 20*a* therewith.

The supporting plate 9, i.e., the ear pad 8 is retained on the cap body 1 through first retaining means $E_1$ and second retaining means $E_2$. The first retaining means $E_1$ comprises a first engaging hole 21 formed at the supporting plate 9, and the first engaging pin 20. The second retaining means $E_2$ comprises a second engaging hole 22 formed at the supporting plate 9, a guide hole 24 formed at the cover plate 11, and an operating member 26 secured at a rear end thereof to the base end of the second engaging pin 25.

The first engaging hole 21 capable of being engaged with the first engaging pin 20 is provided at an upper portion of the supporting plate 9. The first engaging hole 21 is formed in a key hole-like shape having a first engaging portion 21*a* made of a hole elongated in a vertical direction as a first direction and a circular first fitting portion 21*b* continuous from an upper end of the first engaging portion 21*a*. The first fitting portion 21*b* is formed of such a size as to have the first enlarged head 20*a* fitted thereinto, and the first engaging portion 21*a* is so formed as to be engaged at both edges thereof with the first enlarged head 20*a* of the first engaging pin 20 which has been moved from the first fitting portion 21*b*.

That portion of the supporting plate 9 which is located below the insertion hole 14 is formed with a key hole-shaped second engaging hole 22 which comprises a second engaging portion 22*a* made of a hole elongated in a second direction substantially perpendicular to the longitudinal direction of the first engaging portion 21*a* of the first engaging hole 21, i.e., in front and rear directions of the helmet, and a second circular fitting portion 22*b* which is continuous with a front end of the second engaging portion 22*a*. A restriction pin 23 is projected from a portion of the plate 9 between the insertion hole 14 and the second engaging hole 22.

The cover plate 11 is provided with a guide hole 24 extending along the second engaging portion 22*a* and assuming the position corresponding to the second engaging hole 22 when the first engaging pin 20 is engaged with the first engaging hole 21, and a pair of projections 27 for holding the restriction pin 23 from both sides in a state of the first engaging pin 20 being engaged with the first engaging hole 21. Both the projections 27 and the restriction pin 23 constitute rotation preventing means for preventing the supporting plate 9 from rotating around the first engaging pin 20. Further, the projections 27 are formed in a manner that their projecting amounts increase as they approach to each other so that the restriction pin 23 can easily get over the projections 27 from either side thereof.

The second engaging pin 25 having at a tip end thereof a second enlarged head 25*a* capable of being fitted into the second fitting portion 22*b* and being engaged with the second engaging portion 22*a* is inserted into the guide hole 24 in a manner movable in the longitudinal direction of the guide hole 24, and a base end of the second engaging pin 25 is secured to the rear end of an operating member 26.

The operating member 26 is formed in a flat rectangular plate shape of a synthetic resin having relatively high rigidity, and the rear portion of the member 26 is inserted between the cover plate 11 and the shell 2. More specifically, a cutout 28 is formed in a portion of the cover plate 11 nearer the window 6 than the guide hole 24, and the rear portion of the operating member 26 is inserted from the cutout 28 to a position between the cover plate 11 and the shell 2. The operating member 26 is provided at a front end thereof with an operating portion 26*a* which can be placed in contact with the edge member 5 defining an edge of the window 6. The operating member 26 is movable between a separating position (a position shown in FIG. 6) for separating the operating portion 26*a* away from the edge of the window 6 with the second engaging head 25*a* being in a position corresponding to the second engaging portion 22*b*, and an engaging position (a position shown in FIG. 2) for bringing the operating portion 26*a* into contact with the edge of the window 6 to engage the second enlarged head 25*a* with the second engaging portion 22*a*.

Description will now be made of the operation of this embodiment.

In order to attach the ear pads 8 to the cap body 1, the operating portion 26*a* is first pulled up to move the operating member 26 to the separating position, and the ear pads 8 and supporting plates 9 are pushed upwards from the separating position where the first enlarged head 20*a* of the first engaging pin 20 is fitted in the first fitting portion 21*b* of the first engaging hole 21. As a result, the engaging portion 21*a* of the first engaging hole 21 is moved to the engaging position to be engaged with the first engaging pin 20 and thus the supporting plate 9 and the cap body 1 are engaged with each other by the first retaining means $E_1$.

If in this state, the supporting plate 9 is brought to a position where the restriction pin 23 is held between both the projections 27 and 27, then the second enlarged head 25*a* of the second engaging pin 25 assumes a position to be fitted in the second fitting portion 22*b* of the second engaging hole 22. Then, the operating member 26 is pressed toward the engaging position by the operating portion 26*a* and the second engaging pin 25 is moved from the second fitting portion 22*b* to the second engaging portion 22*a*, thereby bringing the second engaging pin 25 into engagement with the second engaging hole 22, placing the supporting plates 9 and the cap body 1 in mutual engagement by the second retaining means $E_2$.

As described above, the supporting plates 9, i.e., the ear pads 8 are secured to the cap body 1 by the first retaining means $E_1$ and the second retaining means $E_2$. Since the operating directions of the first and second retaining means $E_1$ and $E_2$ are substantially perpendicular to each other, the fixed state of the plates 9 to the cap body 1 is reliably maintained. Further, since the operating member 26 is to be clamped between the cover plate 11 and the shell 2 in a state where the user of the helmet puts on the cap body 1, the engaging position of the operating member 26 is fixedly held unless an external force is applied thereto by manually holding the operating portion 26.

Further, since the operating portion 26a is placed in contact with the edge of the window 6 in a state where the ear pad 8 is mounted on the cap body 1, it does not disturb the visual field of the user of the helmet. Further, since the operating portion 26 is not protruded from the cap body 1, a lack of visual harmony is not brought about in external appearance.

Moreover, the coupling band 17 of the chin strap cover 15 is reliably prevented from being dropped out of the first engaging pin 20 by engagement with the supporting plate 9 via the first retaining means $E_1$.

When the ear pads 8 are removed from the cap body 1, the operation reverse to the above described attaching operation may be performed, and the ear pads 8 can easily be removed from the cap body 1 similarly to the attaching operation.

In the embodiment described above, the present invention is applied to the jet type helmet. However, the present invention may also be applied to a full-face type helmet. The first engaging pin 20 of the first retaining means $E_1$ can be projected from the supporting plate 9, and the first engaging hole 21 can be provided at the cover plate 11. further, the second engaging hole 22 can be provided at the cover plate 11, and the operating member 26 can be supported by the supporting plate 9.

What is claimed is:

1. A helmet comprising:

a cap body including ear cover portions at opposite sides of a window provided in a front face;

supporting plates;

ear pads arranged inwardly of said ear cover portions, wherein each of said ear pads is secured to an inner surface of a respective supporting plate;

first retaining means located between said cap body and each said supporting plate, said first retaining means for separating and for engaging the cap body and the supporting plate away from and with each other by a relative sliding movement between mating surfaces of said cap body and the supporting plate performed in a first direction between a first separating position and a first engaging position;

an operating member located between said cap body and each said supporting plate, said operating member performing a sliding movement, between mating surfaces, between a second separating position and a second engaging position in a second direction which is substantially perpendicular to said first direction; and second retaining means located between said cap body and each said supporting plates, said second retaining means for separating and for engaging the cap body and the supporting plate away from and with each other by said sliding movement of said operating member.

2. A helmet according to claim 1, wherein said cap body is secured with a cover plate opposed to each said supporting member to cover an inside of the ear covering portion, said first retaining means comprising a first engaging hole of a key hole-shape provided on said supporting plate having a first engaging portion formed of a hole elongated in said first direction and a first circular fitting portion connected to one end of the first engaging portion, and a first engaging pin projected on the cover plate and having a first enlarged head which is capable of fitting in the first fitting portion and engaging with the first engaging portion, said second retaining means comprising a second engaging hole of a key hole-shape provided on said supporting plate and having a second engaging portion formed of a hole elongated in said second direction and a second circular fitting portion connected to one end of said second engaging portion, a guide hole provided on said cover plate, elongated along the second engaging portion and located such that it comes to a position corresponding to the second engaging hole when the first engaging pin is engaged with the first engaging hole, a second engaging pin inserted into said guide hole and provided at a tip end thereof with a second enlarged head which is capable of fitting in the second fitting portion and engaging with the second engaging portion, and an operating member provided at one of opposite ends thereof with an operating portion and secured at the other end with a base end of said second engaging pin, said operating member being inserted at least at a part thereof between said cover plate and said cap body and being movable between an engaging position where said operating portion is abutted against an edge of said window and said second enlarged head is in engagement with said second engaging portion and a separating position where said operating portion is moved away from the edge of said window and said second enlarged head comes to a position corresponding to said second fitting portion.

3. A helmet according to claim 2, wherein rotation preventing means is provided between said supporting plate and said cover plate to prevent said supporting plate from rotating around said first engaging pin in a state where said first engaging pin is engaged with said first engaging hole.

4. A helmet according to claim 3, wherein said rotation preventing means comprises a restriction pin projected on an outer surface of said supporting plate and a pair of projections projected on said cover plate for holding said restriction pin from opposite sides of said restriction pin.

5. A helmet according to claim 2, wherein a pair of chin straps capable of being connected to each other are secured at respective one ends thereof to the inner surface of said cap body, a chin strap cover for covering part of each of the chin straps comprising a cover body to be brought into contact with the cheek and chin of a user of said helmet, and a coupling band formed continuously from said cover body, and an end of the coupling band being inserted between said supporting plate and said cover plate and connected to said first engaging pin.

* * * * *